US007090469B2

(12) United States Patent
Blumenthal et al.

(10) Patent No.: US 7,090,469 B2
(45) Date of Patent: Aug. 15, 2006

(54) TURBOMOLECULAR PUMP

(75) Inventors: Roland Blumenthal, Erftstadt (DE); Heinz-Dieter Odendahl, Köln (DE); Dieter Bohry, Köln (DE)

(73) Assignee: Leybold Vakuum GmbH, Cologne (DE)

( * ) Notice: Subject to any disclaimer, the term of this patent is extended or adjusted under 35 U.S.C. 154(b) by 311 days.

(21) Appl. No.: 10/473,237

(22) PCT Filed: Mar. 15, 2002

(86) PCT No.: PCT/EP02/02884

§ 371 (c)(1),
(2), (4) Date: Sep. 25, 2003

(87) PCT Pub. No.: WO02/077462

PCT Pub. Date: Oct. 3, 2002

(65) Prior Publication Data

US 2004/0081560 A1 Apr. 29, 2004

(30) Foreign Application Priority Data

Mar. 27, 2001 (DE) ..... 101 14 969

(51) Int. Cl.
*F04B 49/10* (2006.01)

(52) U.S. Cl. ..... 417/32; 417/44.1; 417/45; 417/423.4

(58) Field of Classification Search ..... 417/423.4, 417/32, 44.1, 45
See application file for complete search history.

(56) References Cited

U.S. PATENT DOCUMENTS 6,075,337 A * 6/2000 Ishii et al. ..... 318/801
6,123,522 A 9/2000 Kubo et al. ..... 417/423.4
6,329,732 B1 * 12/2001 Straley ..... 310/68 B
6,335,606 B1 * 1/2002 Minagawa et al. ..... 318/801
6,416,290 B1 * 7/2002 Yamauchi ..... 417/32

FOREIGN PATENT DOCUMENTS

DE 2757599 6/1979
EP 0 967 394 12/1999

* cited by examiner

*Primary Examiner*—Tae Jun Kim
*Assistant Examiner*—Ryan P. Gillan
(74) *Attorney, Agent, or Firm*—Fay, Sharpe, Fagan, Minnich & McKee, LLP

(57) ABSTRACT

A turbomolecular pump (10) comprises a stator (12, 18), a pump rotor (20) a motor (28) for driving the pump rotor and a control device (42). The control device (42) controls the motor output power such that the motor output power does not exceed a permissible maximum motor output power. On the stator side of the turbomolecular pump (10), temperature sensors (32–38) for measuring the stator temperature are arranged. The control device (42) comprises a maximum output power detecting device (50) that determines the permissible maximum motor output power in dependence on the measured stator temperature. Thus, the permissible maximum motor output power is not set to a constant value but always fixed in dependence on the current, measured stator temperature. Thereby, the capacity of the motor can be fully utilized as long as the measured stator temperature lies below a maximum value.

12 Claims, 2 Drawing Sheets

TURBOMOLECULAR PUMP

BACKGROUND OF THE INVENTION

The invention relates to a turbomolecular pump with a pump stator, a fast rotating pump rotor and a motor for driving the pump rotor.

In a turbomolecular pump, a gas or gas particles are compressed by rotating blades of the pump rotor and the stationary blades of the pump stator to a multiple of the supply pressure to generate a high-vacuum. The gas heating caused by the gas compression and gas friction is mainly dissipated again. via the pump rotor and the pump stator. While the cooling of-the pump stator can be effected by cooling channels carrying a cooling fluid, the active pump rotor cooling is problematic since no cooling fluid can be supplied to the rotating pump rotor. Under unfavorable operational conditions, the pump rotor may therefore overheat. In case of an overheating of the pump rotor beyond a maximally permissible rotor temperature, there is the danger of destroying the pump rotor and, as a consequence, the pump stator. Therefore, the turbomolecular pump always has to be operated below the maximally permissible rotor temperature.

A direct measurement of the rotor temperature is only possible at great efforts because of the difficult signal transmission from the fast rotating pump rotor to the stator. Therefore, the turbomolecular pump comprises a control device restricting the motor output power to a predetermined constant maximum motor output power so that the pump output power and the gas and rotor heating correlating therewith are restricted to a constant maximum value as well.

The permissible maximum motor output power is detected by calculating and/or experimentally by assuming the most unfavorable process conditions for the pump operation, such as a gas with a thermally unfavorable behavior, a bad pump stator cooling, high ambient temperatures etc. The permissible maximum motor output power is selected so that the pump rotor cannot exceed the maximally permissible rotor temperature even under the most unfavorable process conditions. By fixing a constant maximum motor output power, the motor output power is restricted to the predetermined maximum output power even if the process conditions are more favorable than assumed for calculating the maximum motor output power. Thus, the motor output power is restricted to the predetermined maximum motor output power even if the actual rotor temperature has not reached the maximally permissible rotor temperature yet. Since the extreme process conditions underlying the detection of the maximally permissible maximum motor output power only represent a rare exceptional case in practice, the output power of the turbomolecular pump is normally restricted to a value far below an actually thermally permissible value.

Therefore, it is an object of the invention to provide a device and a method by means of which the output power of a turbomolecular pump is increased.

SUMMARY OF THE INVENTION

According to the invention, a temperature sensor for measuring the stator temperature is arranged at the pump stator. Further, the control device comprises a maximum output power detecting device determining the permissible maximum motor output power in dependence on the measured stator temperature. This means that the permissible maximum motor output power is no constant invariable value but is determined in dependence on the respective stator temperature. The rotor temperature strongly correlates with the temperature of the stator-side parts of the pump, with, for example, the temperature of the base flange, the pump housing, the motor housing, the bearing housing, the pump stator, the motor as well as the actual motor and pump output power, respectively. Therefore, the stator temperature gives information about the rotor temperature so that also the rotor temperature can be reliably restricted to a maximum value by measuring the stator temperature and restricting the permissible maximum motor output power for the respective stator temperature. By measuring the stator temperature and the conclusions that can be drawn therefrom with respect to the rotor temperature, the permissible maximum motor output power is adapted to the respective thermal situation and therefore normally lies above a constant permissible maximum motor output power determined for most unfavorable thermal conditions. The actual motor output power and thus the output power of the pump can thus be clearly increased under normal process conditions. At the same time, the pump rotor is protected more reliably against overheating, i.e., exceeding the maximally permissible rotor temperature, since an indirect monitoring of the rotor temperature is effected.

According to a preferred embodiment, the maximum output power detecting device comprises a rotor temperature detecting device detecting the rotor temperature from the stator temperature measured by the temperature sensor. Subsequently, the maximum output power detecting device determines the permissible maximum motor output power in dependence on the detected rotor temperature.

The rotor temperature detecting device detects the motor rotor temperature from one or more different stator temperatures substituted into a polynomial the constant coefficients of which have been detected experimentally before. Thus, the permissible maximum motor output power can be finally detected fast and with little memory space as well. If necessary, the restriction of the maximum motor output power may not intervene until a threshold temperature of the rotor is reached, and restrict the permissible maximum motor output power while the maximum motor output power is not restricted as long as the calculated rotor temperature is below the threshold temperature. The permissible maximum motor output power may also be detected directly from a polynomial resolved according to the permissible maximum motor output power and in which the rotor threshold temperature and/or a rotor maximum temperature is already included in the form of coefficients.

The maximum motor output power calculated on the basis of the coefficients may even be additionally restricted by other parameters, if necessary.

Preferably, several temperature sensors are provided at different sites of the stator, the maximum output power detection device determining the permissible maximum motor output power in dependence on the measured temperatures of all temperature sensors. The temperature sensors can be arranged at the housing of the turbomolecular pump, at a pump stator element, at a stator-side part of the motor, e.g., at the motor housing or at the motor winding, or in a cooling channel of the pump stator. The temperature sensors can also be arranged at other stator-side sites of the turbomolecular pump the temperature and temperature behavior of which permit reliable conclusions with respect to the temperature of the rotor. Thus, from a plurality of measured temperatures, a precise conclusion with respect to the rotor temperature and thus the permissible maximum motor output power is made possible. Therefore, the restriction of the motor output power is effected close to the objectively permissible maximum motor output power. The detection of the rotor temperature and the permissible maximum motor output power by several stator-side temperature sensors is so reliable and precise that only small safety margins have to be provided to avoid an overheating of the rotor. Thus, the motor can be driven with a maximum of thermally permissible output power, i.e., the output power potential of the motor and the pump can always be approximately completely utilized.

According to a preferred embodiment, the maximum output power detecting device comprises a characteristics diagram memory in which the permissible maximum motor output power for each stator temperature is stored in a characteristics diagram. In the characteristics diagram, a complex non-linear characteristics line can be stored as well so that a complicated detection of the permissible maximum motor output power by calculating operations can be omitted.

According to another method for restricting the maximally permissible motor output power of a motor in a turbomolecular pump, which drives a pump rotor borne in a pump stator, the following method steps are provided: measuring the pump stator temperature, detecting a permissible maximum motor output power from the measured pump stator temperature, and restricting the motor output power to the detected permissible maximum motor output power.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
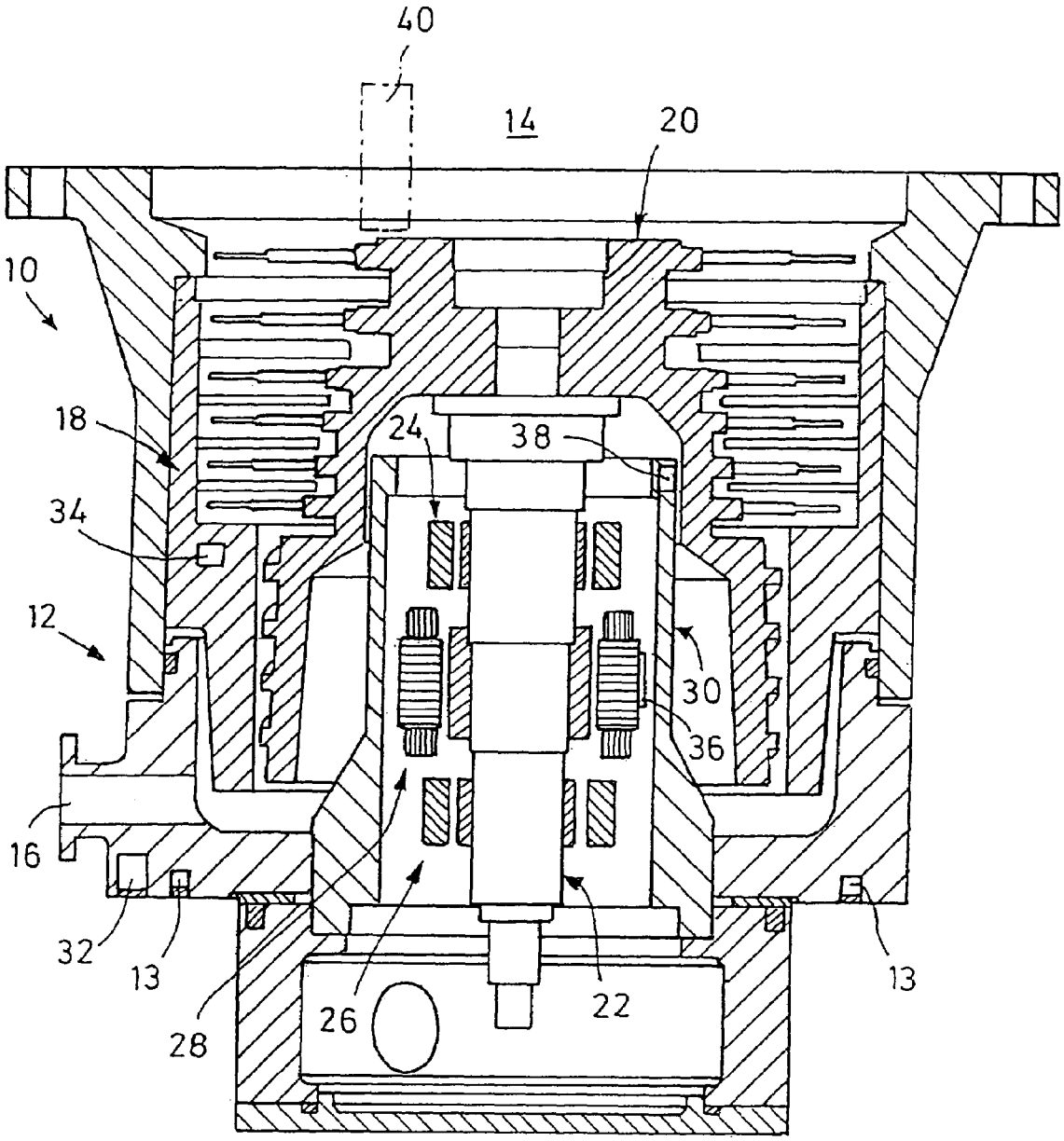
FIG. 1 shows a turbomolecular pump in longitudinal cross section, with several temperature sensors.

In FIG. 1, a turbomolecular pump 10 is illustrated that comprises a pump housing 12 the one longitudinal end of which forms the suction side 14 and the other end of which forms the delivery side and comprises a gas outlet 16. In the pump housing 12, a pump stator 18 is arranged to interact with a pump rotor 20. The pump rotor 20 comprises a rotor shaft 22 rotatably supported in the pump housing 12 with two radial magnetic bearings 24, 26 and a non-illustrated axial bearing. The rotor shaft 22 and the pump rotor 20 connected therewith are driven by an electric motor 28. The electric motor 28 and the two radial magnetic bearings 24, 26 are accommodated in a common bearingmotor housing 30. The pump housing 12 is cooled by a coolant flowing through a cooling channel 13 in the pump housing 12. The turbomolecular pump 10 serves to generate a high-vacuum and rotates at rotational speeds up to 100,000 rpm.

On the stator side, i.e., on the side of the stationary parts, the turbomolecular pump 10 comprises several temperature sensors 32–38. A first temperature sensor 32 is arranged in the region of the base flange of the pump housing 12. A second temperature sensor 34 is arranged at or in the pump stator 18. A third temperature sensor 36 is arranged at the motor 28 and measures the temperature prevailing in the region of the motor windings and the magnetic guiding plates of the motor. A fourth temperature sensor 38 is arranged at the bearing-motor housing 30. A further temperature sensor may be arranged in the course of the cooling channel 13.

The heat transferred to the pump rotor 20 by the gas heating of the compressed gas and induced in the pump rotor 20 by the active magnetic bearings 26 and the electric motor 28 is substantially dissipated from the pump rotor 20 to the stator-side parts by heat radiation. Apart from their self-heating, the stator-side parts, i.e., the pump housing 12, the pump stator 18, the bearing-motor housing 30 as well as the magnetic bearings 24,26 and the electric motor 28, are hence also heated by the heat radiated onto them by the pump rotor 20. The measurement of the temperature and the temperature course of the mentioned stator-side parts therefore allows conclusions with respect to the rotor temperature.

The relation between the actual temperature of the pump rotor 20 and the temperatures of the stator-side parts measured by the temperature sensors 32–38 can be detected by a simple experimental set-up. To this end, a rotor temperature sensor 40 is suitably arranged on the suction side as close to the pump rotor 20 as possible. Thus, the rotor temperature can be measured directly in the experiment so that the connection between the rotor temperature and the temperatures measured by the stator-side temperature sensors 32–38 can be recorded under different process conditions. From the temperatures and temperature courses recorded by all temperature sensors 32–40, a polynomial for the motor output power P in dependence on the rotor temperature and the stator-side temperatures can be detected:

$$P=\alpha_0+\alpha_1 T_1^{\beta_1}+\alpha_2 T_2^{\beta_2}+\alpha_3 T_3^{\beta_3} \ldots \alpha_n T_n^{\beta_n}.$$

P is the instantaneous motor output power, $T_1$ to $T_n$ are the respectively measured temperatures of the stator-side temperature sensors 32–38 and the rotor temperature sensor 40. The coefficients $\alpha_0$ to $\alpha_n$ as well as $\beta_1$ to $\beta_n$ are constants detected by evaluating the experimentally measured pump rotor and pump stator temperatures. If the maximally permissible rotor temperature is put into this polynomial instead of the measured rotor temperature, the permissible maximum motor output power $P_{max}$ is detected with this polynomial.

Thus, a polynomial is presented with which the permissible maximum motor output power $P_{max}$ can be calculated for a set of simultaneously measured stator temperatures $T_1$ to $T_n$, respectively.

Figure 2:
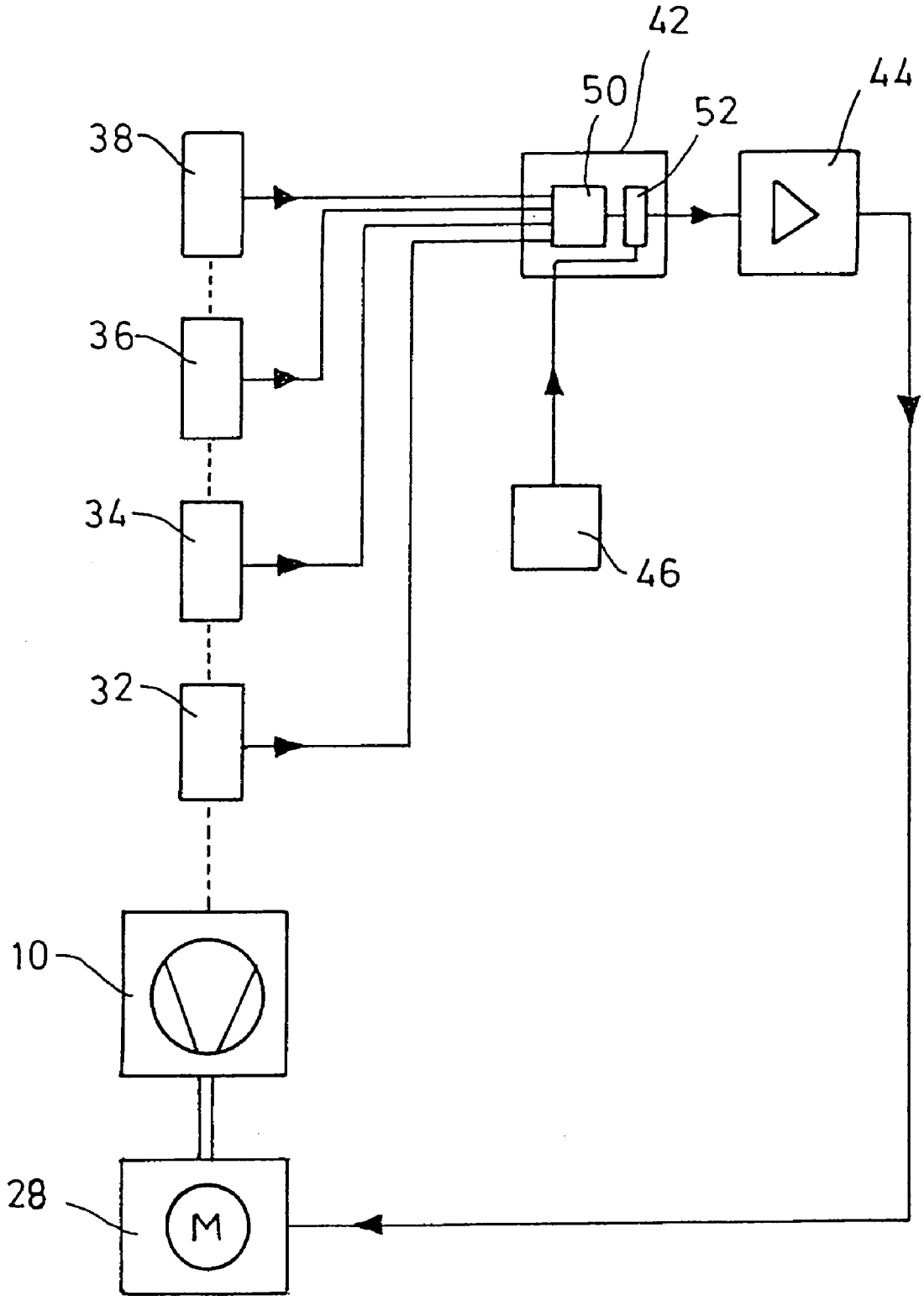
FIG. 2 shows a block diagram of the control of the turbomolecular pump of FIG. 1.

In FIG. 2, the control of the pump rotor motor 28 is schematically illustrated. A control device 42 controls a motor driver 44 which, in turn, drives the windings of the electric motor 28. Via an actuator 46, a motor output power nominal value is put out to the control device 42. The control device 42 comprises a maximum output power detecting device 50 and an output power limiter 52. In the maximum output power detecting device 50, the permissible maximum motor output power $P_{max}$ is detected, according to the formula indicated above, from the temperature values supplied by the four temperature sensors 32–38. In the output power limiter 52, the motor output power nominal value supplied by the actuator 46 is restricted to the detected permissible maximum motor output power if the output power value indicated by the actuator 46 is greater than the detected permissible maximum motor output power. Thus, the rotor temperature is restricted to a maximum temperature so that the rotor is protected from destruction by overheating.

Aside from the cooling fluid temperature, the actual motor output power, the ambient temperature and other measurable variables can also be used as further parameters for the detection of the permissible maximum motor output power.

By means of the described device, it is possible to draw conclusions with respect to the present rotor temperature via several stator-side temperature sensors. To avoid an overheating of the pump rotor to a temperature above a maximum rotor temperature, a permissible maximum motor output power to which the motor output power is restricted is detected from the detected rotor temperature. Thus, the permissible maximum motor output power is variable so that the capacity of the motor and the pump can be fully utilized and is only restricted in the case of a danger of overheating.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A turbomolecular pump including:

a stator, a pump rotor, a motor for driving the pump rotor, a control device for controlling the motor, the control device controlling the motor output power such that the motor output power does not exceed a permissible maximum motor output power, a temperature sensor for measuring the stator temperature arranged on the stator side, and the control device including a maximum output power detecting device which determines a variable permissible maximum motor output power in dependence on variations in the measured stator temperature.

2. The turbomolecular pump according to claim 1, wherein several temperature sensors are provided at different sites of the stator, and the maximum output power detecting device determines the permissible maximum motor output power in dependence on the measured temperatures of all temperature sensors.

3. The turbomolecular pump according to claim 1, wherein the maximum output power detecting device has a rotor temperature detecting device allocated thereto which detects the rotor temperature from the stator temperature measured by the temperature sensor, and the maximum output power detecting device determines the permissible maximum motor output power in dependence on the detected rotor temperature.

4. The turbomolecular pump according to claim 1, wherein the maximum output power detecting device detects the permissible maximum motor output power by means of a polynomial.

5. A turbomolecular pump including:

a pump rotor, a motor for driving the pump rotor, a control device for controlling the motor, the control device controlling the motor output power such that the motor output power does not exceed a permissible maximum motor output power, a temperature sensor for measuring the stator temperature arranged on the stator side, and the control device including a maximum output power detecting device which determines a changeable permissible maximum motor output power in dependence on change in the measured stator temperature, the maximum output power detecting device comprising a characteristics field memory in which the permissible maximum motor output power for each stator temperature is stored in a characteristics field.

6. The turbomolecular pump according to claim 1, wherein the temperature sensor is provided at a pump housing.

7. The turbomolecular pump according to claim 1, wherein the temperature sensor is provided at a pump stator.

8. The turbomolecular pump according to claim 1, wherein the temperature sensor is provided at a stator-side part of the motor.

9. The turbomolecular pump according to claim 1, wherein the motor includes a housing and the temperature sensor is provided at the motor housing.

10. The turbomolecular pump according to claim 1, further including:

a cooling channel defined in the stator, the temperature sensor being arranged along the course of the cooling channel.

11. A method for restricting output power of a motor in a turbomolecular pump, said motor driving a pump rotor borne in a stator, with the method steps of:

measuring a pump stator temperature, determining a permissible maximum motor output power in dependence on the measured pump stator temperature, permissible maximum motor output power varying with variations in the measured pump stator temperature, controlling the motor to restrict the motor output power to the determined permissible maximum motor output power.

12. The method according to claim 11, wherein detecting the permissible maximum motor output power includes the steps of:

calculating the pump rotor temperature from the measured pump stator temperature, determining the permissible maximum motor output power from the calculated pump rotor temperature.

* * * * *